United States Patent [19]

Brooks et al.

[11] 4,183,001

[45] Jan. 8, 1980

[54] TRANSFORMERS FOR INDUCTION HEATING EQUIPMENT

[75] Inventors: David S. Brooks, Sheperton; Trevor C. Savage, Caterham on the Hill, both of England

[73] Assignee: Electroheating (London) Limited, London, England

[21] Appl. No.: 972,460

[22] Filed: Dec. 22, 1978

Related U.S. Application Data

[63] Continuation of Ser. No. 808,546, Jun. 21, 1977, abandoned.

[51] Int. Cl.[2] ..... H01F 21/04; H01F 27/28

[52] U.S. Cl. ..... 336/62; 336/123

[58] Field of Search ..... 336/122, 123, 121, 120, 336/115, 62, 65, 67, 68

[56] References Cited

U.S. PATENT DOCUMENTS

| | | | |
|---|---|---|---|
| 1,131,187 | 3/1915 | Von Arco et al. | 336/123 |
| 1,394,044 | 10/1921 | Stephens | 336/62 X |
| 1,471,096 | 10/1923 | Brand | 336/62 |
| 1,759,987 | 5/1930 | Knapp | 336/123 |
| 2,484,561 | 10/1949 | Flyer | 336/123 |
| 3,503,026 | 3/1970 | Geisel et al. | 336/62 |

OTHER PUBLICATIONS

Published Abandoned Application S.N. 726,378, Published 12/6/49, Glyyas, Jr.

*Primary Examiner*—Thomas J. Kozma

*Attorney, Agent, or Firm*—Finnegan, Henderson, Farabow & Garrett

[57] ABSTRACT

One of two coils of approximately the same diameter, forming the primary and secondary coils of a transformer for tube welding or other induction heating equipment, is mounted for movement relative to the other, preferably about a pivotal axis parallel to the axes of the coils, to enable its axis to be shifted towards and away from the axis of the other coil and the coils are so arranged that loops or turns of each coil, which are connected together in series or parallel, can pass between the loops or turns of the other coil to facilitate changing the coupling factor and thus adjusting the power delivered to the heating coil.

8 Claims, 2 Drawing Figures

TRANSFORMERS FOR INDUCTION HEATING EQUIPMENT

Figure 1:
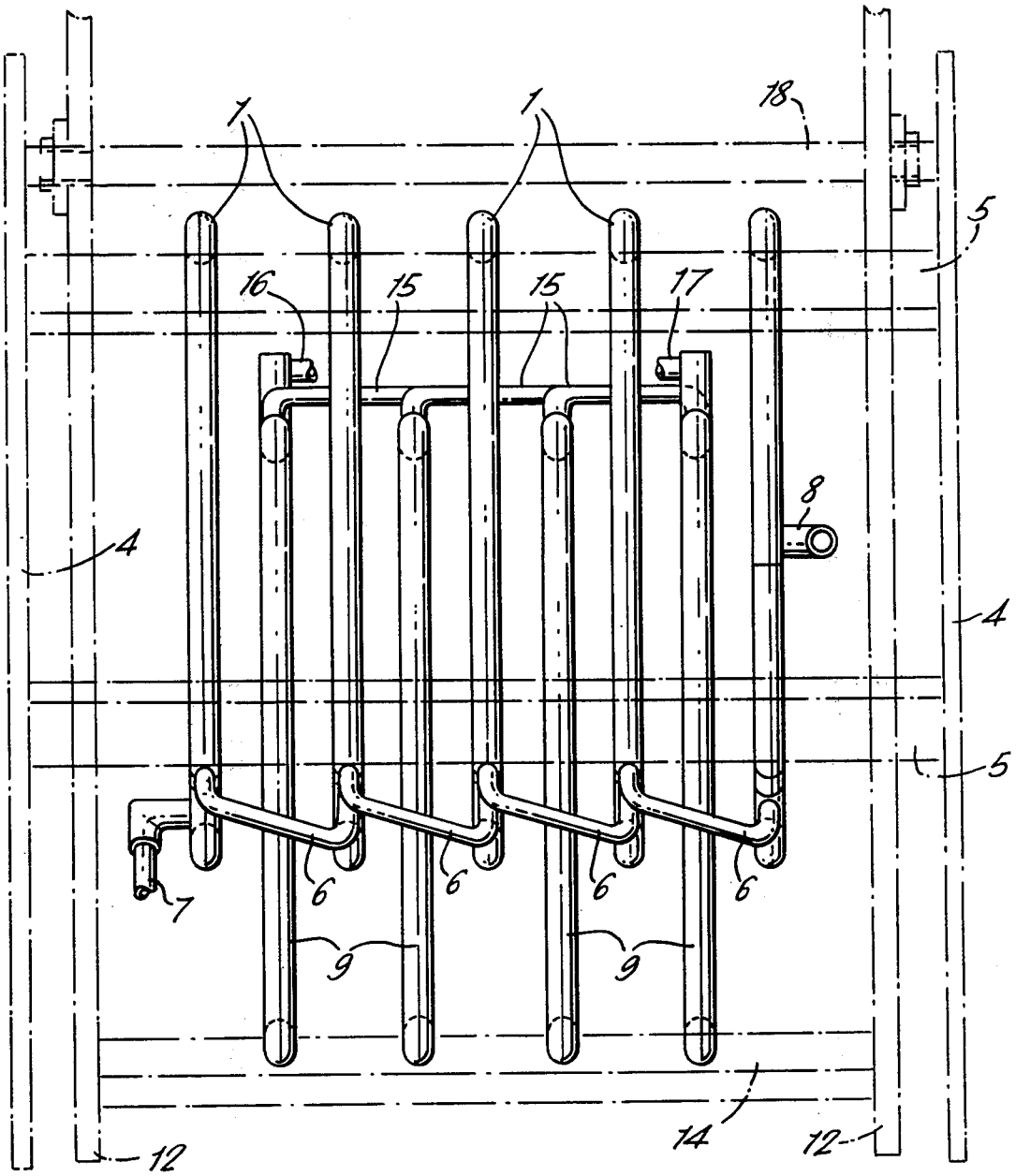

This is a continuation, of application Ser. No. 808,546, filed June 21, 1977, now abandoned.

This invention relates to transformers for induction heating equipment particularly though not exclusively for use in tube welding.

In conventional induction heating equipment the tank coil of a high frequency oscillator forms the primary winding of a transformer whose secondary winding is connected to the heating coil. The transformer is generally air cored but can sometimes have iron or ferrite type cores and the loops of the primary and secondary windings are normally self supporting being made of copper tube through which cooling liquid passes.

In some applications, particularly tube welding, it is often desirable to adjust the power delivered to the heating coil by changing the coupling factor of the transformer. In order to provide this adjustability the transformer coils in prior arrangements have been arranged one inside the other on a common horizontal axis. One of the coils is mounted on suitable tracks for axial movement relative to the other and to allow this movement it is provided with flexible leads and flexible cooling fluid supply tubes.

Those known transformers suffer from considerable drawbacks. Firstly a large clearance has to be left between the coils to allow for misalignment during adjustment and this clearance reduces the maximum coupling factor obtainable by the transformer. Also, water condensation on the coils tends to drip from one coil to another causing serious electrical problems. Another difficulty is that a relatively complicated and slow moving mechanical system is required to effect adjustment of the movable coil. A further problem arises from the fact that the tubes are normally made wider in the axial direction than in the radial direction. This is necessary to ensure the best coupling factor but leads to mechanical instability. Yet another problem is that a lead to one of the coils must pass through the other coil during adjustment and this upsets the electrical system.

According to the invention there is provided a transformer for induction heating equipment in which the primary or secondary coil is movable so that its axis can be moved towards or away from the axis of the other coil, and in which the loops or turns of one coil are displaced axially relative to those of the other coil so that the loops or turns of each coil can pass between the loops or turns of the other.

In order to enable the coils to assume a perfectly co-axial condition when a maximum coupling factor is required, each loop preferably lies in a plane perpendicular to the axis of its coil and is linked to the next loop by a coupling piece which lies outside the generally cylindrical space occupied by the coil.

If a turns ratio other than one-to-one is required this can be obtained by an arrangement in which the two loops at opposite ends of one coil lie outside those of the other coil in the axial direction. Also some or all of the loops of one coil may be connected in parallel, thereby varying the number of effective turns in the electrical circuit without appreciably affecting the coupling factor. For example, alternate loops of one coil can be connected together in pairs thereby halving the number of effective turns.

The coils are preferably mounted with their axes horizontal so that condensation dripping from one coil falls between the loops of the other coil. The coil movement is preferably pivotal since this helps to give a simple, accurate adjustment enabling the use of small tolerances and consequent improvement in the maximum coupling factor attainable.

To give the best results the coils should be of equal diameter so that when the coils are co-axial, any intermediate loop of one coil faces two loops of the other coil. This gives an even further improvement in the coupling factor. Because facing loop surfaces extend radially, the tubes forming the coils are preferably made broadest in the radial direction of the coil and this gives the added advantage of improved mechanical stability. When moving the coils apart, a position is reached where the coupling factor becomes zero which is itself a useful facility and also means that a relatively small coil movement is necessary to give a large reduction in power. This can give improved speed of adjustment and a reduction in the overall size of the equipment.

Figure 2:
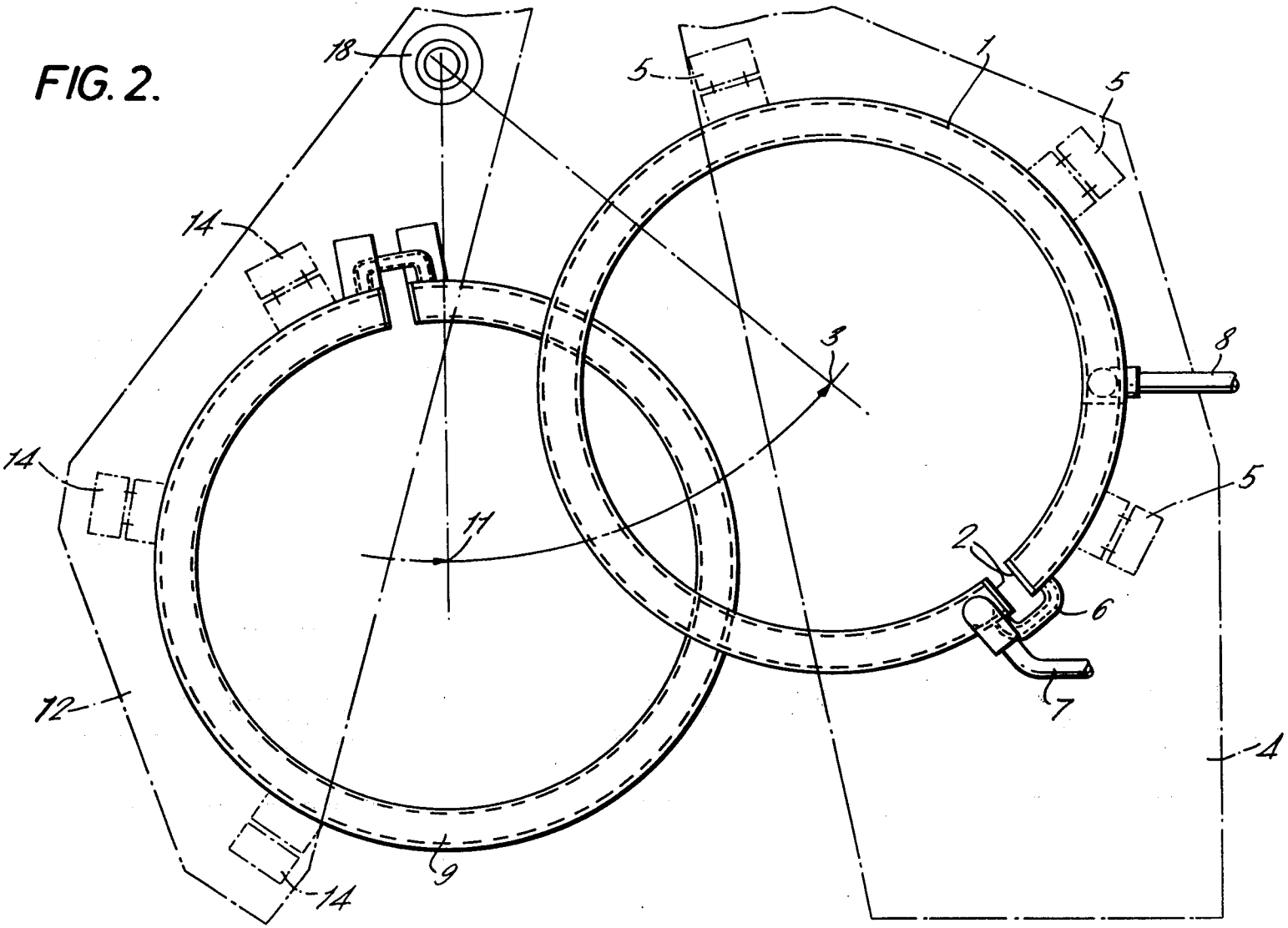

A particular embodiment of the invention will now be described by way of example with reference to the accompanying drawings in which:

FIG. 1 shows a side view of the coils of a transformer constructed in accordance with the invention; and FIG. 2 shows an end view of the coils of the same transformer, the coil supports being shown in broken lines in both drawings.

The illustrated transformer comprises a primary coil which is made up from five loops 1. As can be seen in FIG. 2 each loop is formed from a length of copper tubing which is sealed at its ends 2, the tubing being bent into a circle so that these ends lie adjacent each other.

The loops 1 are mounted in planes perpendicular to a common horizontal central axis 3 by a fixed support structure comprising end plates 4 and cross-pieces 5. Only two of the cross-pieces are shown in FIG. 1.

The loops 1 are joined in series as shown by short couplings 6 of copper tubing which lie outside the cylindrical space occupied by the loops. The outer two coils 1 are connected to a source of power by flexible conductors 7 and 8. Cooling water is fed to and from the coil through flexible rubber hoses (not shown).

The secondary coil is formed of four loops 9 (similar to and of the same diameter as loops 1) joined in series by couplings 15 (similar to couplings 6).

The loops 9 are mounted in planes perpendicular to a common horizontal central axis 11 by an adjustable support structure comprising end plates 12 and cross-pieces 14. Only one cross-piece 14 is shown in FIG. 1.

The outer two loops 9 of the secondary coil are connected to the welding equipment (not shown) by flexible conductors 16 and 17. As in the case of the primary coil, cooling water passes into and out of the secondary coil through flexible rubber hoses (also not shown).

The cross pieces 14 are fixed to end plates 12 which are mounted on a horizontal spindle 18 which can be rotated by means (not shown) to any desired position.

The loops 9 of the secondary coil are axially offset from the loops 1 of the primary coil and the distance, between the spindle 18 and the central axes 3 and 11 of the two coils are identical. By rotating the spindle 18 it is possible to move the secondary coil into a position where it is co-axial with the primary. This co-axial position gives the highest coupling factor. When the power requirement of the welding equipment is low it may be desirable to reduce the coupling factor and this can simply be achieved by moving the secondary coil by the required amount away from the position where it is co-axial with the primary coil.

In the illustrated embodiment of the invention the primary coil has one loop more than the secondary. In other embodiments it could have one less or the same number of loops as the secondary. When it is desired to construct a transformer whose turns ratio is very much different from unity it is possible for some of the loops or even all the loops of one coil to be connected in parallel by coupling members similar to those shown at 6 and 15.

The invention is particularly applicable to tube welding techniques where power requirements frequently vary according to the type and size of tube being made. However, it is to be understood that it could also be applied in other fields of technology.

We claim:

1. A fluid-cooled transformer for induction heating equipment, said transformer comprising a tubular primary coil and a tubular secondary coil having parallel axes and including means for passing a cooling fluid through said tubular coils, each coil having a support structure comprising end plates joined together in spaced relation by cross-pieces and a plurality of loops or turns mounted on said support structure, each of said loops or turns being a length of tubing sealed at at least one end and bent until its ends lie adjacent to and spaced from each other, the support structure of one of said coils having its end plates mounted on a spindle which extends parallel to and is equally spaced from the axes of both coils and is rotatable about its axis to move said coil relative to the other to shift its axis towards and away from the axis of the other, said loop or turn of one coil being displaced axially relative to those of the other coil with the turns of one coil alternating, in an axial direction, with the turns of the other so that a loop or turn of one coil can pass between two adjacent loops or turns of the other when said one coil is moved relative to the other.

2. A transformer according to claim 1 in which each loop or turn lies in a plane substantially perpendicular to the axis of its coil.

3. A transformer according to claim 2 in which each loop or turn is linked to the next loop or turn by a coupling which lies outside a generally cylindrical space occupied by the coil.

4. A transformer according to claim 1 in which the axes of the coils are horizontal.

5. A transformer according to claim 1 in which the movable coil is pivoted for rotation about an axis parallel to the central axis of the coil.

6. A transformer according to claim 1 in which the coils are of approximately equal diameter.

7. A transformer according to claim 1 in which the conductor forming the turns of each coil has a greater dimension in the radial direction of the coil than in the axial direction.

8. A transformer according to claim 1 in which two loops or turns at opposite ends of one coil lie outside those of the other coil in the axial direction.

* * * * *